US006305561B1

(12) United States Patent
Kaufhold et al.

(10) Patent No.: US 6,305,561 B1
(45) Date of Patent: Oct. 23, 2001

(54) DRAFT SILL WITH LOCKING CENTER PIN

(75) Inventors: Horst T. Kaufhold, Aurora; Jeffery R. Ladendorf, Chicago, both of IL (US); John F. Oesch, Alliance, OH (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/483,083

(22) Filed: Jan. 14, 2000

(51) Int. Cl.[7] ..... B61G 7/10
(52) U.S. Cl. ..... 213/51; 213/75 R
(58) Field of Search ..... 213/50.5, 51, 62 R, 213/75 R, 77, 86, 98; 105/199.4, 420

(56) References Cited

U.S. PATENT DOCUMENTS

| | | | | |
|---|---|---|---|---|
| 5,201,827 | * | 4/1993 | Glover et al. | 213/61 |
| 5,207,718 | * | 5/1993 | Glover et al | 213/62 |
| 5,397,007 | * | 3/1995 | Hanes et al. | 213/50 |
| 5,931,101 | * | 8/1999 | Kaufhold et al. | 105/420 |

* cited by examiner

*Primary Examiner*—S. Joseph Morano
*Assistant Examiner*—Robert J. McCarry, Jr.
(74) *Attorney, Agent, or Firm*—Edward J. Brosius

(57) ABSTRACT

A draft sill end casting with a locking center pin is disclosed. The draft sill has an open member with an elongate channel aligned with the central aperture of its center plate. A support shelf is within the elongate channel. A center pin has an upper retainer key supported on the shelf, and the center pin extends through the elongate channel to the exterior of the draft sill. The lower end of the center pin has a slot. When mounted on a truck bolster, a lower retainer key is slid through slots in the bolster walls and through the slot in the lower end of the center pin. The two retainer keys, support shelf and bolster walls lock the center pin in position, limiting axial movement of the center pin and limit rotation of the center pin. Thus, the draft sill and truck bolster are locked together to limit relative vertical and horizontal movement between them. The shelf may include rotation stops to limit rotation of the upper retainer once it is in place. The draft sill includes a key passage so that the upper retainer key and center pin can be removed if desired. In two embodiments, the key passages are through the support shelf and lead to the exterior of the draft sill; in these embodiments, the center pin and retainer key can be removed from the draft sill as a unit. In another embodiment, the key passage is formed as a slot in the interior wall of the draft sill above the support shelf; in this embodiment, the retainer key and center pin must be removed independently of one another.

20 Claims, 5 Drawing Sheets

DRAFT SILL WITH LOCKING CENTER PIN

BACKGROUND OF THE INVENTION

1. Field of the Invention

The present invention relates to draft sills for use with railway car trucks and to center pins extending between draft sills and railway car trucks.

2. Description of the Prior Art

In a typical railway freight train, such as that shown at 10 in FIG. 1, railway cars 12, 14 are connected end to end by couplers 16, 18. The couplers 16, 18 are each received in draft sills 20, 22. The draft sills 20, 22 are at the ends of the railway car's center sill, and include center plates that rest in center plate bowls 24 of railway car trucks 26, 28.

As shown in FIG. 2, each typical car truck 26 comprises a pair of side frames 30, 32 supported on wheel sets 34, 36. A hollow bolster 38 extends between and is supported on springs 40 on the side frames. The bolster center plate bowl 24 has a central opening 42. One draft sill with a center plate is supported on each car truck, with the draft sill center plate received within the bolster center plate bowl.

The draft sills typically have a top wall that is usually welded to a shear plate that is connected to the bottom of the railway car. The two draft sills are connected to the two ends of the car center sill that runs the length of the car.

In the event the railway car encounters a bump or other event causing relative vertical motion between the car truck and the draft sill, the shallow center plate bowl may not retain the center plate, and the center plate and center plate bowl could separate and move horizontally with respect to each other so that the draft sill is no longer supported on the bolster center plate bowl. To prevent such relative horizontal motion, center pins have typically been used in the prior art to loosely connect each draft sill to each truck.

In some applications, it has been desirable to lock the center plate and center plate bowl together to limit relative vertical and horizontal movement between these parts. In one prior art assembly, a fabricated draft sill was assembled, with one end of the center pin fixed in the interior of the draft sill with a retainer plate and pins. The other end of the center pin was fixed in the interior of the bolster with a large retainer plate extending through the bolster walls and the center pin. This prior art design had disadvantages: the center pin could not be removed from the fabricated draft sill without disassembling part of the draft sill. In addition, this locking design could not be readily applied to cast draft sills.

SUMMARY OF THE INVENTION

The present invention is directed to providing a draft sill that allows for interlocking the draft sill center plate and the bolster center plate bowl, while also allowing for disassembly and removal of the center pin without removing the draft sill from the railway car and without destroying or disassembling the draft sill.

In one aspect, the present invention provides a draft sill for a railway car. The draft sill includes a center plate with an interior edge defining a central aperture and an open member within the draft sill. The open member has an interior wall defining an elongate channel aligned with the central aperture of the center plate. The elongate channel and central aperture each have a central longitudinal axis. The open member includes a shelf within the elongate channel. The shelf defines an angle with the central longitudinal axis of the open member, and includes a key passage. The draft sill has a key passage from the exterior of the center plate to the key passage in the shelf.

In another aspect, the present invention provides, in combination, a draft sill for a railway car, a center pin and a retainer key. The draft sill includes a center plate with an interior edge defining a central aperture. The draft sill also includes an open member within the draft sill. The open member has an interior wall defining an elongate channel aligned with the central aperture of the center plate. The elongate channel and central aperture each have a central longitudinal axis. The open member includes a shelf within the elongate channel. The shelf defines an angle with the central longitudinal axis of the open member. The draft sill further includes a key passage through a portion of the draft sill. The retainer key is supported on the shelf and extends to and contacts the center pin. The key passage is sized, shaped and positioned to allow for passage of the retainer key from outside of the draft sill through the draft sill to the elongate channel.

In another aspect, the present invention provides, in combination, a draft sill, a center pin and a railway truck bolster. The draft sill includes a center plate and an open member. The center plate has an inner edge defining a central aperture. The open member is within the draft sill and has an elongate channel and a support member within the elongate channel. The center pin extends between the draft sill and the truck bolster. The center pin has a central longitudinal axis. Upper and lower retainer keys extend through the center pin to limit axial movement of the center pin and to limit relative vertical motion between the draft sill and the truck bolster. The upper retainer key is supported on the support member in the elongate channel and is movable with the center pin. The lower retainer key limits relative motion between the center pin and the truck bolster. The draft sill also includes a key passage from the support member to the exterior of the draft sill. The draft sill and truck bolster are separable by removing the lower retainer key and separating the draft sill and center pin from the truck bolster. The center pin is removable from the draft sill by separating the draft sill and center pin from the bolster, turning the center pin about its central longitudinal axis, and moving the center pin and upper retainer key axially down through the elongate channel and key passage toward the center plate and through the central aperture in the center plate.

BRIEF DESCRIPTION OF THE DRAWINGS

The intention will be described in conjunction with the attached drawings, in which like reference numerals have been used for like parts and in which.

DETAILED DESCRIPTION

Draft sills embodying the features of the present invention are illustrated in FIGS. 3–6, 9–12 and 14 of the accompanying drawings. The draft sill of the present invention allows the center plate of the draft sill to be vertically and horizontally locked with the center plate bowl of the bolster of the truck supporting the draft sill while allowing relative rotation between the draft sill center plate and truck bolster center plate bowl. The connection between the draft sill and truck bolster can also be selectively unlocked to separate the draft sill from the bolster and to remove the center pin if desired.

A draft sill utilizing the features of the present invention may include many of the features of prior art draft sills. Although one or more particular types of draft sill are illustrated in the accompanying drawings, it should be understood that the principles of the present invention may be applied to draft sills having other designs and other features. For example, although a one-piece end casting is shown, with the center plate cast as part of the draft sill, the principles of the present invention could also be applied to draft sills of the type having a center plate pocket to receive a center filler plate structure as disclosed and shown in U.S. Pat. No. 4,252,068 (1981) to Nolan.

Figure 4:
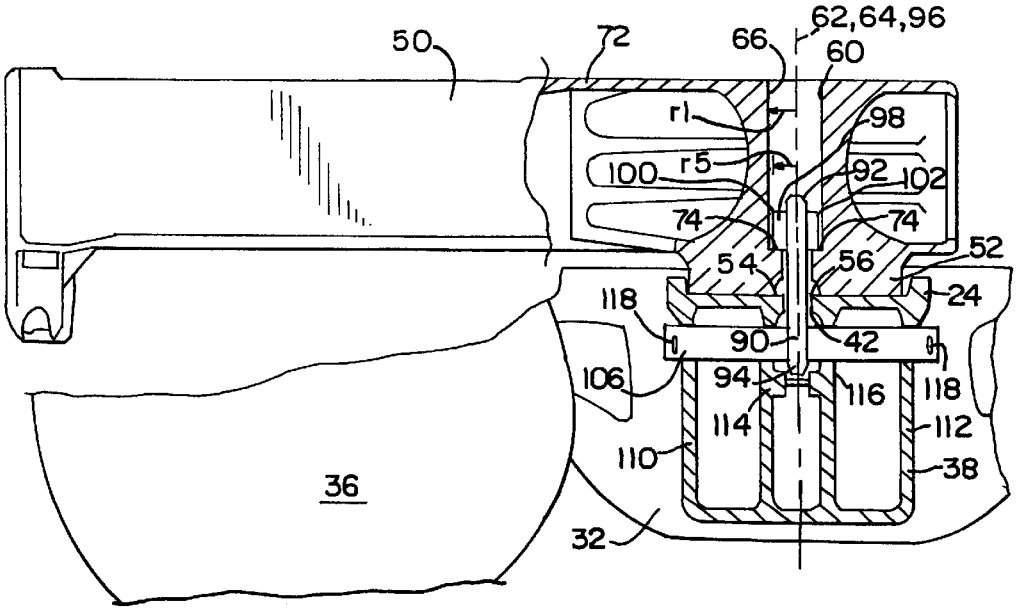
FIG. 4 is an elevation, with parts shown in cross-section, of a draft sill, center pin and railway car truck bolster illustrating the features of the first embodiment of the present invention.
Figure 5:
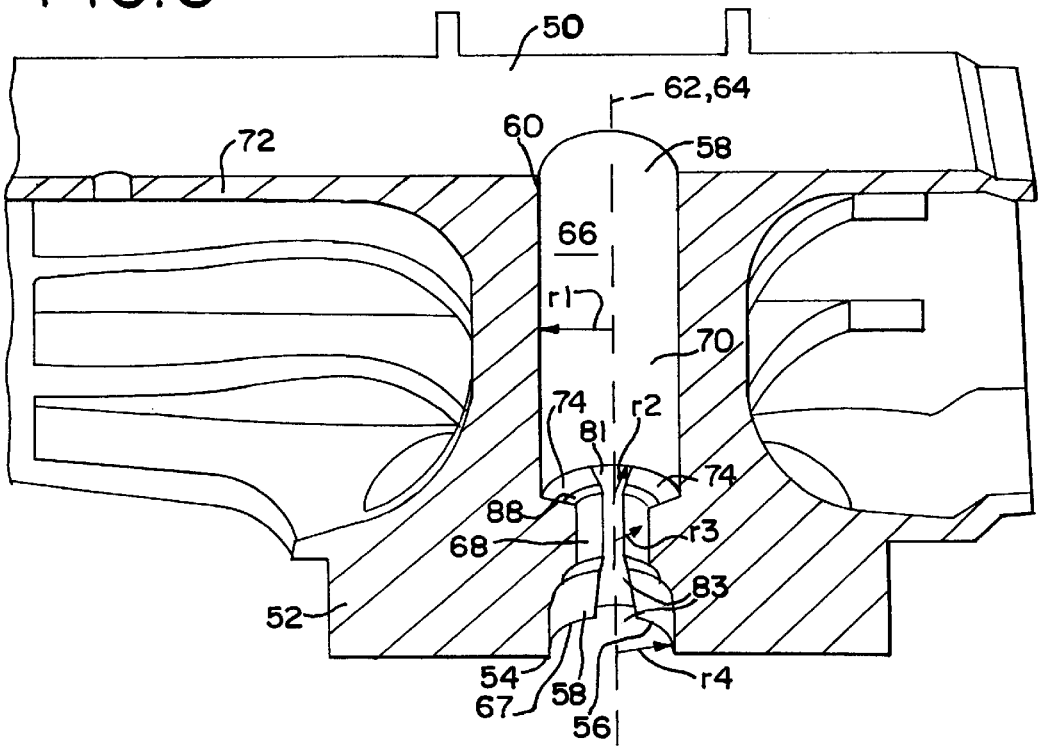
FIG. 5 is a perspective cross-sectional view of the back portion of the draft sill of FIGS. 3–4, the cross-section being taken along the longitudinal centerline of the draft sill.
Figure 6:
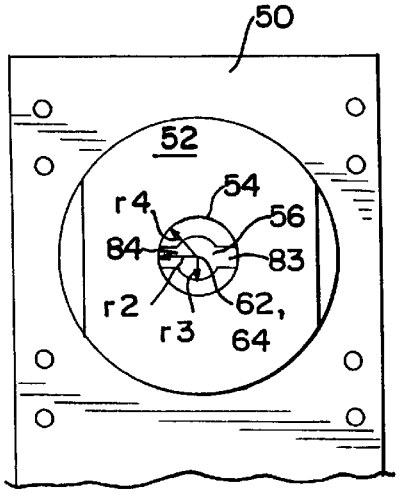
FIG. 6 is a bottom plan view of the center plate of the draft sill of FIGS. 3–4, shown removed from the railway car truck bolster.

A first embodiment of a draft sill is shown in FIGS. 3–6 and 11–12 at 50. The first illustrated draft sill 50 has a downwardly-extending center plate 52. Around the center of the center plate 52, there is an interior edge 54 defining a central aperture 56, as shown in FIG. 6. This central aperture 56 is aligned with an elongate channel 58 of an open member 60 in the interior of the draft sill 50. The elongate channel 58 and central aperture 56 each have a central longitudinal axis 62, 64. These axes 62, 64 are co-linear in the illustrated embodiment.

As in some prior art draft sills, the elongate channel 58 of the open member 60 of the illustrated draft sill 50 is defined by an interior wall 66 of the open member 60. Moreover, like many prior art designs, the elongate channel 58 has different diameters at different elevations. As shown in FIG. 5, near the center plate 52, the elongate channel 58 has a bell shaped end 67 leading to a reduced diameter portion 68. The reduced diameter portion 68 extends upward from the interior side of the center plate 52. The elongate channel 58 of the open member 60 also has an expanded diameter portion 70 extending upward from the reduced diameter portion 68. In the illustrated embodiment, the expanded diameter portion 70 of the open member extends upward to the top wall 72 of the draft sill 50, although it should be understood that the open member 60 need not extend this full distance.

As shown in the cross-sections of FIGS. 4 and 5, the open member 60 also includes a shelf or support member 74 at the junction of the reduced diameter portion 68 and the expanded diameter portion 70 of the elongate channel 58. The shelf 74 defines an angle with the central longitudinal axis 62 of the elongate channel 58 of the open member 60. In the illustrated embodiment, the shelf 74 is perpendicular to the central longitudinal axis 62 of the open member's elongate channel 58.

The draft sill 50 of the first and second embodiments of the present invention includes a key passage 80 in the shelf 74 within the elongate channel 58 and a key passage 82 extending from the exterior of the center plate 52 to the key passage 80 in the shelf 74. In the first illustrated embodiment of the present invention, there are two key passages 80, 81 in the shelf, and two key passages 83, 84 leading from the exterior of the center plate 52 to the key passages 80, 81 in the shelf 74. The key passages 83, 84 are accessible through the central aperture 56 of the center plate 52, and the central aperture 56 of the center plate 52 may comprise part of the key passages 83, 84. In the second embodiment illustrated in FIGS. 9–10, there is a single key passage 82 in the shelf 74 and a single key passage 85 leading to the exterior of the center plate 52.

In the first illustrated embodiment, the key passages 80, 81, 83, 84 comprise slots. One key slot or passage 80 in the shelf 74 is vertically aligned with the key slot or passage 84 in the interior wall 66 of the open member 60, and the other key slot or passage 81 in the shelf 74 is vertically aligned with the key slot or passage 83 in the interior wall 66 of the open member. One pair of vertically aligned key slots 80, 84 is diametrically opposed to the other pair of vertically aligned key slots 81, 83. The key passages 83, 84 need not comprise slots their entire lengths, but may, for example, include a large diameter open channel portion of the elongate channel, such as the bell-shaped portion 67 shown in FIG. 5.

As shown in FIGS. 5–6, the radial distance from the central longitudinal axis 62 of the elongate channel 58 to the interior wall 66 in the expanded diameter portion 70, is shown at r1. The radial distance from the central longitudinal axis 62 to the interior wall 66 in a vertical plane extending through the key passages 81, 83 is shown at r2. The radial distance from the central longitudinal axis 62 to the interior wall 66 in a vertical plane spaced from all of the key passages 80, 81, 83, 84 is shown at r3. This distance r3 is substantially the distance between the central longitudinal axis 62 and the inner diameter 88 of the shelf 74. And the radius of the central aperture 56 of the center plate 52 is shown at r4. In the first illustrated embodiment, r1, r2 and r4 are all greater than r2. In this embodiment, r1, r2 and r4 are all about 2 inches, and r3 is slightly greater than 1 inch, although it should be understood that the present invention is not limited to any particular dimensions unless expressly set forth in the claims.

Figure 1:
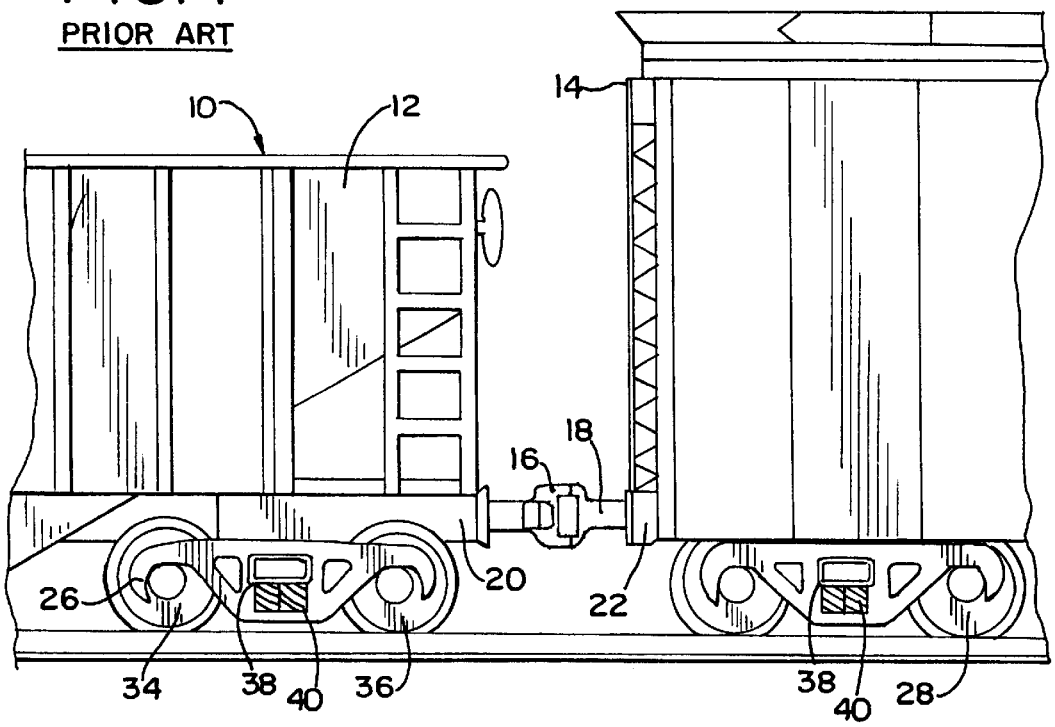
FIG. 1 PRIOR ART
FIG. 1 is a schematic elevation of the coupled ends of two railway freight cars.
Figure 2:
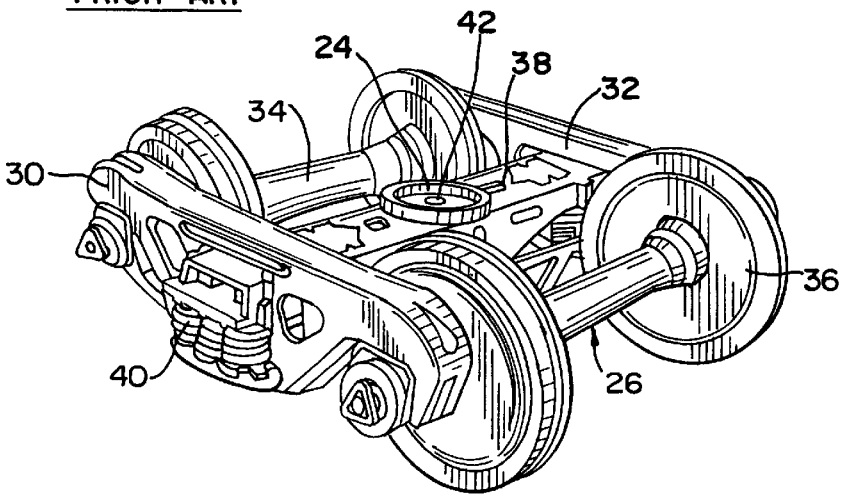
FIG. 2 PRIOR ART
FIG. 2 is a perspective view of a typical prior art railway car truck.
Figure 3:
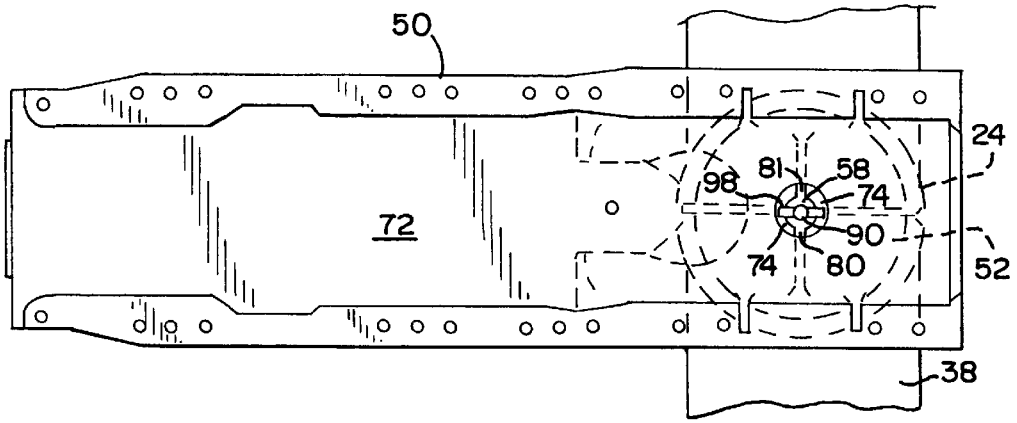
FIG. 3 is a top plan view of a draft sill mounted on a railway car truck bolster.

As shown in FIGS. 3–4, a center pin 90 extends from a first end 92 in the draft sill 50 through the central aperture 56 of the center plate 52 to a second end 94 outside of the draft sill. The first end 92 and a portion of the length of the center pin 90 are positioned in the elongate channel 58. The center pin 90 has a central longitudinal axis 96 that is substantially co-linear with the central longitudinal axes 62, 64 of the elongate channel 58 and the central aperture 56 of the center plate 52 in the first illustrated embodiment.

The center pin 90 has an upper retainer key 98 within the interior of the draft sill. The upper retainer key 98 in the first illustrated embodiment extends diametrically through the center pin 90, and extends radially outward from the center pin body in two directions to two ends 100, 102 radially spaced from the central longitudinal axis 96 of the center pin. The radial distance from the central longitudinal axis 96 of the center pin 90 to one end 100 is shown at r5 in FIGS. 4 and 11. In the illustrated embodiment, r5 is less than r1, but greater than r3. This radial distance r5 is about 1 15/16 inches in the illustrated embodiment, although the invention is not limited to this distance.

Figure 7:
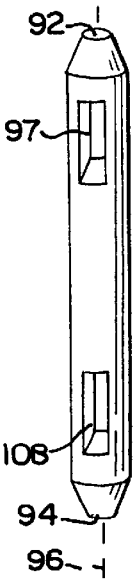
FIG. 7 is a perspective view of the center pin of FIG. 3, shown with both the upper and the lower retainer keys removed.
Figure 7A:
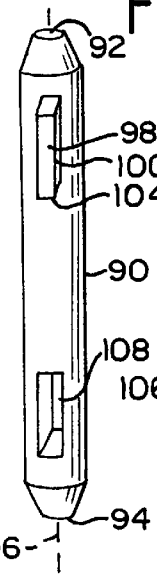
FIG. 7A is a perspective view of the center pin of FIGS. 3 and 7, shown with the upper retainer key inserted in the upper slot and with the lower retainer key removed.

The upper retainer key 98 has a planar bottom surface 104, shown in FIG. 7A, that rests upon the shelf 74 in the elongate channel 74 when the center pin and draft sill are assembled as shown in FIGS. 3–4.

Figure 8:
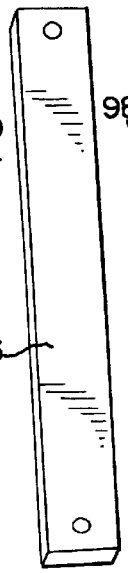
FIG. 8 is a perspective view of a lower retainer key.
Figure 8A:
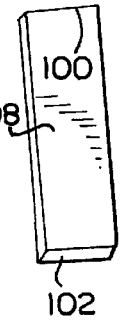
FIG. 8A is a perspective view of an upper retainer key.

As shown in FIG. 8A, the upper retainer key 98 may comprise a bar of A36 steel, with dimensions of 3⅞ inches by 2½ inches by ½ inch for example. It should be understood that this material and these dimensions are provided by way of example only, and that other materials may be used, and that other shapes and sizes of materials may be used. Generally, the material used and the dimensions for the material used for the upper retainer key should provide sufficient strength to withstand anticipated loads. The center pin may comprise a standard commercially available center pin made of A36 steel with an opening machined or otherwise formed to accept the upper retainer key 98. The opening or slot should be formed to extend diametrically through the center pin. The center pin 90 may have a length, for example, of about 15 inches and a diameter of about 2 inches, although the invention is not limited to these dimensions unless expressly set forth in the claims. To assemble the center pin and upper retainer key, the upper retainer key 98 may be inserted through the diametrical slot in the center pin. The upper slot, shown in FIG. 7 at 97, has dimensions of about 2¾ inches by ⅝ inch. The center pin and upper retainer may be fixed together such as by welding, or cotter pins or the like may be inserted to fix the center pin and upper retainer key together. However, no means of fixing the upper retainer key to the center pin should be required since there is limited space within the elongate channel 58 for movement of the upper retainer key 98 out of the upper slot 97 in the center pin.

The draft sill key passages 80, 81, 83, 84 may be sized and shaped to complement the size and shape of the upper retainer key 98. The key passages 83, 84 may comprise slots as illustrated, but need not define slots over their entire lengths. For example, parts of the key passages 83, 84 may be defined by a large diameter open portion of the elongate channel.

As shown in FIG. 4, the center pin 90 extends through the central aperture 42 of the center plate bowl 24 into the interior of the truck bolster 38. Within the bolster 38, a lower retainer key 106 extends through a second slot formed in the center pin 90. The second slot is shown at 108 in FIGS. 7 and 7A. The second slot 108 is machined or otherwise formed to extend diametrically through the center pin. The lower slot may have dimensions of 2¾ inches by ⅝ inch, for example.

Figure 13:
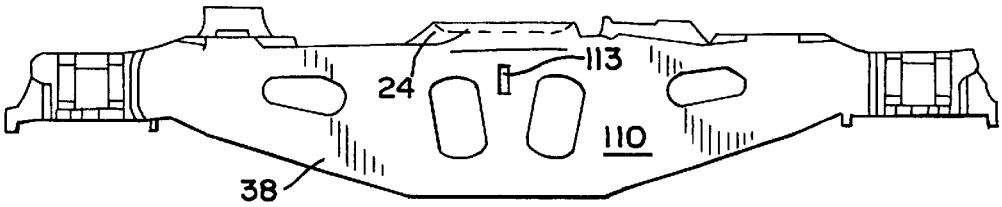
FIG. 13 is a side elevation of a bolster with a slot in an exterior wall for receiving a lower retainer key.

As shown in FIG. 4, the lower retainer key 106 in the first illustrated embodiment is substantially longer than the upper retainer key 98. The lower retainer key 106 is long enough to extend through the center pin 90 and at least one wall of the bolster 38. In the embodiment of FIG. 4, the lower retainer key 106 extends through apertures or slots in both the front and back exterior walls 110, 112 of the bolster 38, as well as through apertures or slots in two interior walls 114, 116 and through the lower slot 108 in the center pin 90. The apertures or slots in the bolster and the second slot 108 in the center pin 90 are sized large enough to allow the lower retainer key 106 to be slid into and out of place, and small enough to substantially limit up, down and rotational movement of the lower retainer key 106. A representative slot in an exterior bolster wall 110 is shown at 113 in FIG. 13. This slot 113 may have dimensions of about 2¾ inches by ⅝ inch, for example. The slots in the interior walls and other exterior wall may be of the same size.

In the first illustrated embodiment, the second or lower retainer key is made of A36 steel, and as shown in FIG. 8, has dimensions of 16¾ inches by 2½ inches by ½ inch. It should be understood that this material and these dimensions are provided by way of illustration only, and that the present invention is not limited to any particular material or dimension unless expressly set forth in the claims. To prevent the lower retainer key 106 from slipping out of the slots in the bolster, cotter pins or other similar devices, shown at 118 in FIG. 4, may be inserted through holes in the two ends of the lower retainer key after assembly.

Figure 11:
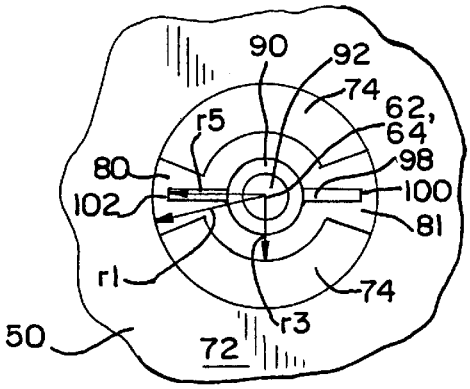
FIG. 11 is a top plan view of a portion of the first embodiment of the draft sill of FIGS. 3–5, looking down through the elongate channel of the open member, illustrating the center pin and upper retainer key in the key passages in the shelf support.
Figure 12:
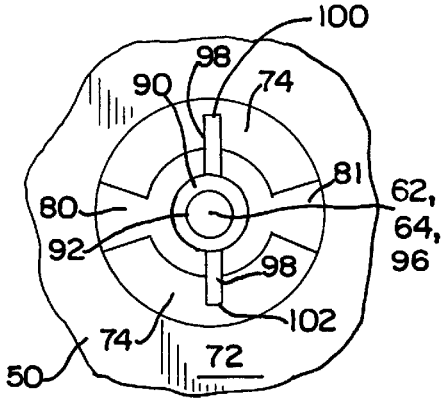
FIG. 12 is a top plan view similar to the view of FIG. 11 showing the center pin after it has been rotated 90° about its central longitudinal axis, with the upper retainer key supported on the shelf in the elongate channel.

To assemble the first illustrated embodiment of the invention, the upper retainer key 98 is inserted into the center pin 90. The assembled center pin and upper retainer key are then aligned as shown in FIG. 11, with the upper retainer key 98 aligned with the key passages 80, 81, 83, 84 in the draft sill. With the upper retainer key 98 so aligned, the assembled center pin and upper retainer key may be moved upward axially through the central aperture 54 of the center plate 52 and through the elongate channel 58 of the open member 60 until the bottom surface 104 of the upper retainer key 98 is at or above the level of the shelf 74 in the elongate channel 58. The assembled center pin and upper retainer key may then be rotated about 90° about the central longitudinal axis 96 of the center pin to the position shown in FIG. 12. The center pin 90 may then be released, and the shelf 74 will support the center pin and prevent it from falling out of the draft sill.

The draft sill and center pin may then be assembled onto a railway car truck. To mount the draft sill and center pin on the truck, the lower retainer key 106 is first left off of the center pin. The second end 94 of the center pin 90 is aligned with the central aperture 42 of the bolster center plate bowl 24. The center pin may then be moved into the interior of the bolster 38 to the position shown in FIG. 4. With the center pin so positioned, the lower retainer key 106 may then be inserted through the slot 113 in one of the exterior bolster walls 110, 112, through the aligned slot in the nearest interior bolster wall 114, 116, through the second slot 108 in the center pin, and out through the other bolster walls. Then cotter pins may be inserted into holes in the lower retainer key to limit movement of the lower retainer key with respect to the bolster.

The slots in the bolster walls, such as slot 113, and the second slot 108 in the center pin 90 are only slightly larger than the lower retainer key 106. Accordingly, once the lower retainer key is inserted as shown in FIG. 4, the bolster walls 110, 112, 114, 116 will limit rotation of the center pin about its central longitudinal axis 96. Since center pin rotation is limited, the position of the upper retainer key 98 is substantially fixed in the position shown in FIG. 12, with the upper retainer key supported on the shelf 74. The upper retainer key 98 and shelf 74 cooperate to limit axial movement of the center pin 90 in the downward direction. The lower retainer key 106 and bolster cooperate to limit axial movement of the center pin in both upward and downward directions and to limit rotation of the center pin. Thus, the truck bolster 38 and draft sill 50 are kept together, and relative vertical and horizontal movement between them is limited.

In use, the top of the draft sill is frequently welded or otherwise affixed to a shear plate beneath the railway car, and the shear plate is affixed to the underside of the railway car. In the event that it is desired to remove the truck from the draft sill, this result can be accomplished in the present invention without removing the draft sill from the railway car. To separate the truck and draft sill, the cotter pins 118 may be removed and the lower retainer key 106 slid out of the slots. The truck and draft sill may then be separated. If it is desired to remove and replace the center pin, this may be accomplished without disassembling the draft sill and railway car. The center pin 90 may be rotated about its central longitudinal axis 96 by turning the free second end 94 until the upper retainer key 98 is aligned with the key passages 80, 81, 83, 84, in the position shown in FIG. 11. The center pin 90 may then be moved in a downward axial direction to remove it from the draft sill 50.

Figure 9:
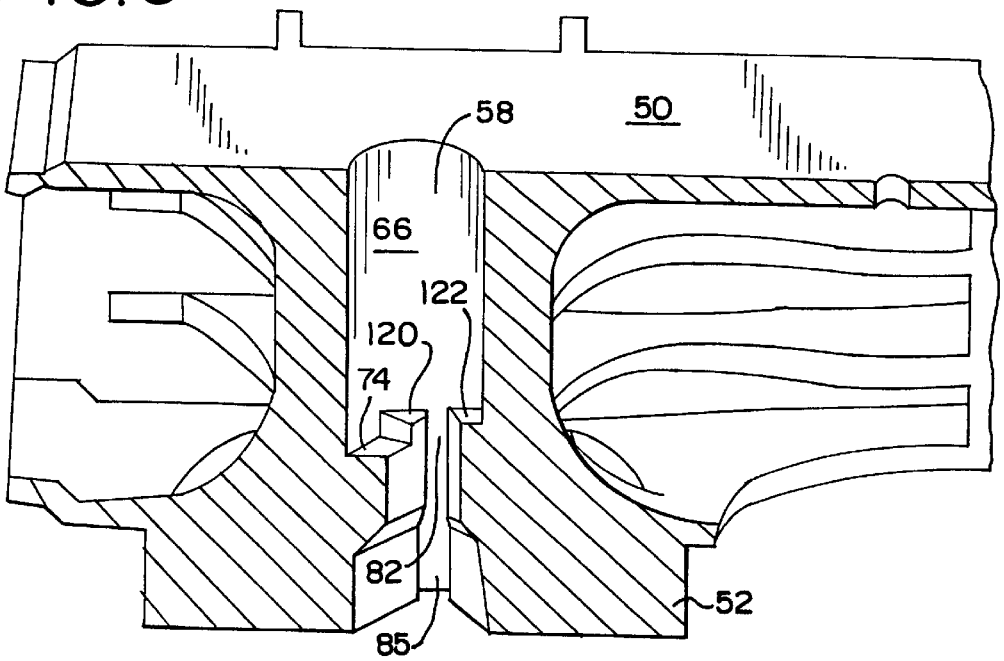
FIG. 9 is a perspective cross-sectional view of the back portion of a draft sill illustrating another embodiment of the present invention, the cross-section being taken along the longitudinal centerline of the draft sill.
Figure 10:
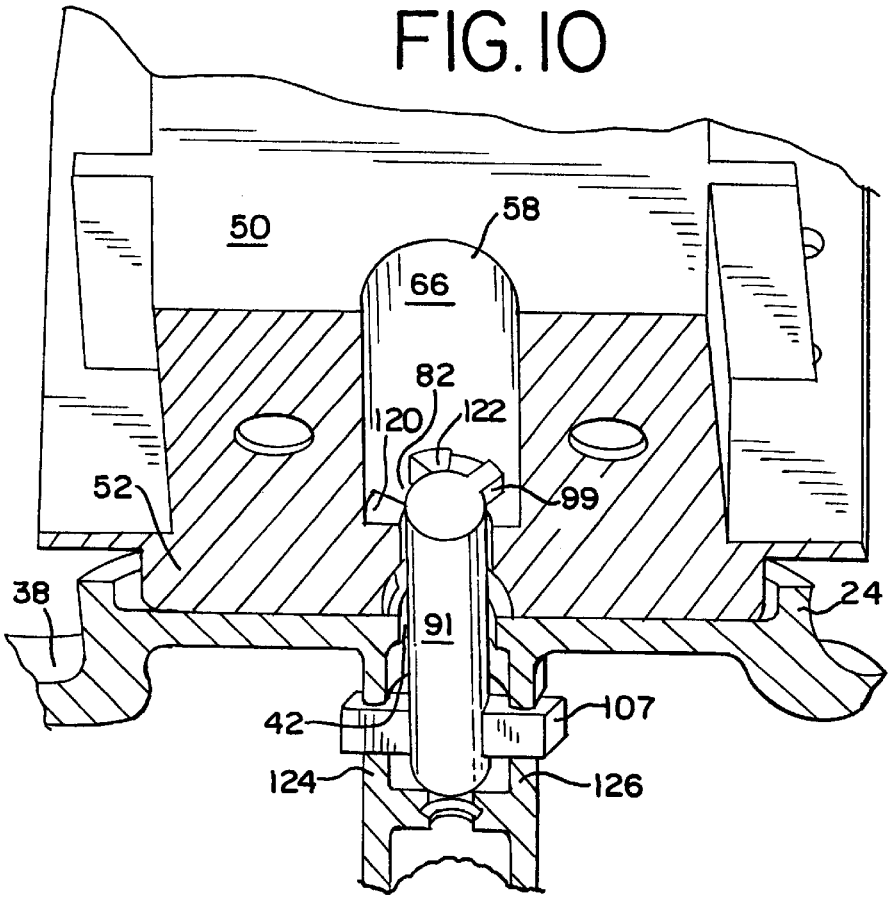
FIG. 10 is a perspective cross-sectional view of a portion of a draft sill utilizing the principles of the embodiment of FIG. 9, the cross-section being taken along a transverse plane through the center of the center plate.

A second embodiment of the invention is illustrated in FIGS. 9–10. In this embodiment, a pair of rotation stops 120, 122 extend axially upward from the shelf 74. In the embodiment illustrated in FIGS. 9–10, the upper retainer key 99 of the center pin 91 extends radially outward from only one side of the center pin 91. Only a single key passage 82 is provided in the shelf 74, and a single key passage 85 leads from the shelf to the exterior of center plate 52. The rotation stops 120, 122 are on both sides of the key passage 82 in the shelf To install the center pin 91 in this embodiment, the upper retainer key 99 must be aligned with the passage 85 and pushed upward through the passage 85 and through the passage 82 in the shelf. The first end 92 of the center pin 91 must be moved upward axially to a point where the bottom surface 104 of the upper retainer key 99 is at or above the tops to the rotation stops 120, 122. The center pin 91 may then be rotated about its central longitudinal axis 96 and dropped onto the shelf 74 between the two rotation stops 120, 122. So positioned, the center pin 91 cannot move axially downward even if rotated, but the upper retainer key may move on the shelf between the two rotation stops 120, 122. As shown in FIG. 10, a smaller second or lower retainer key 107 may be inserted through slots formed in one or more interior walls 124, 126 of the bolster 38 and through a second slot in the center pin 91. As there shown, the lower retainer key 107 may be at a 90° angle to the orientation for the first embodiment. This shorter retainer key 107 can be installed through one of the existing holes in the bolster exterior walls and through slots formed in the bolster interior walls.

Figure 14:
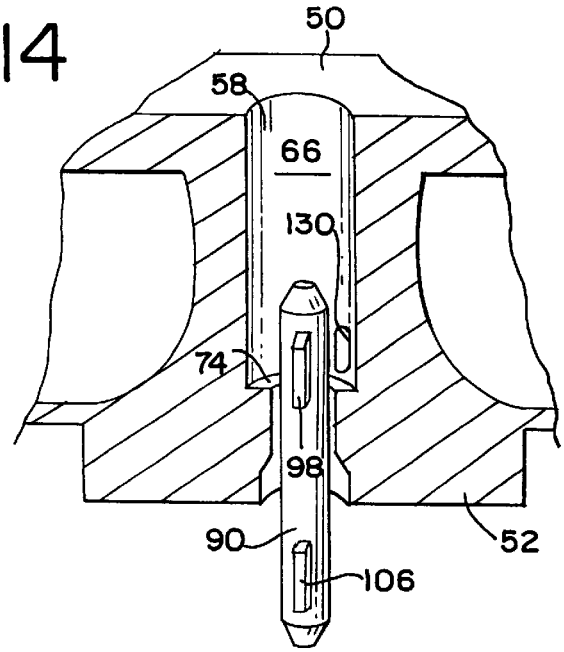
FIG. 14 is a cross-section of a portion of another embodiment of a draft sill taken along the longitudinal centerline of the draft sill.

A third embodiment of a draft sill is illustrated in FIG. 14. In this embodiment, the key passage 130 is through a side wall of the draft sill and through the interior wall 66 of the open member 60. In this embodiment, the upper retainer member 98 may be inserted through the slot 130 and into a slot in the top portion of the center pin 90. The center pin may then be rotated about its central longitudinal axis until the upper retainer key is spaced from the slot 130. The lower retainer key may then be inserted to maintain the rotational and axial position of the center pin.

A draft sill according to the present invention can be made in the standard manner, and preferably comprises a draft sill end casting. The draft sill may be cast of standard grades of steel for such products, such as For a casting, one or more appropriately shaped cores may be used to define the desired shapes of key passages 80, 81, 82, 83, 84, 85, 130. The bolster may also be cast with appropriately shaped cores to define the slots 113, or slots could later be machined in the bolster walls. The upper and lower retainer keys 98, 106 may be made of standard metal bar stock. The center pin may be made in a standard manner with the slots formed by machining.

Although the invention has been described with respect to a cast draft sill, it should be understood that its principles could also be applied to a fabricated draft sill.

While only specific embodiments of the invention have been described and shown, it is apparent that various alternatives and modifications can be made thereto, and that parts of the invention may be used without using the entire invention. Those skilled in the art will recognize that certain modifications can be made in these illustrative embodiments. It is the intention in the appended claims to cover all such modifications and alternatives as may fall within the true scope of the invention.

We claim:

1. A draft sill for a railway car, the draft sill including:

a pair of spaced side walls having top and bottom edges, at least parts of the top edges lying in a top plane and at least parts of the bottom edges lying in a separate bottom plane;

a center plate having an exterior bearing surface having an edge defining a central aperture, the central aperture having a central longitudinal axis extending between the side walls, at least part of the exterior bearing surface lying in a plane spaced from the top plane and bottom plane of the side walls, the bottom plane of the side walls being between the plane of the exterior bearing surface and the top plane of the side walls; and an open member having a wall defining an elongate channel aligned width the central aperture of the center plate, the elongate channel having a central longitudinal axis extending through the central aperture of the center plate;

wherein the open member includes a shelf defining an angle with the central longitudinal axis of the open member, the shelf including a key passage; and wherein the draft sill has a key passage from the exterior of the center plate to the key passage in the shelf.

2. The draft sill of claim 1 wherein the shelf includes a key slot and the interior wall of the open member includes a key slot extending from the shelf key slot, the key slots defining the key passages.

3. The draft sill of claim 1 wherein the elongate channel of the open member has a reduced diameter portion extending upward from the center plate and an expanded diameter portion extending upward from the reduced diameter portion, the shelf being at the juncture of the reduced diameter portion and expanded diameter portion.

4. The draft sill of claim 3 wherein the reduced diameter portion of the elongate channel of the open member has a large dimension in a plane through the key passage and a smaller dimension in a plane spaced from the key passage.

5. The draft sill of claim 1 further comprising a center pin in the elongate channel of the open member, the center pin having two ends and extending from a first end in the draft sill through the central aperture of the center plate to a second end outside of the draft sill;

the center pin having a central longitudinal axis and a retainer key between the two ends of the center pin, the retainer key having at least one end radially spaced from the central longitudinal axis of the center pin and supported on the shelf in the interior of the draft sill.

6. The draft sill of claim 5 wherein the shelf has an inner diameter in the elongate channel, the radial distance from the central longitudinal axis of the channel to the inner diameter of the shelf being less than the radial distance from the central longitudinal axis of the center pin to the end of the retainer key.

7. The draft sill of claim 6 wherein the radial distance from the central longitudinal axis of the elongate channel to the interior wall of the elongate channel at the key passage is greater than the radial distance from the central longitudinal axis of the center pin to the end of the retainer key.

8. The draft sill of claim 7 wherein the center pin is removable from the draft sill by rotating the center pin about its central longitudinal axis until the retainer key is aligned with the key passage in the shelf and then moving the center pin downwardly, with the retainer key traveling through the key passage until the center pin is below the center plate.

9. The draft sill of claim 7 wherein the retainer key is spaced from the key passage in the shelf.

10. The draft sill of claim 9 wherein the shelf prevents axial movement of the center pin in one direction while the retainer key is supported on the shelf and spaced from the key passage in the shelf.

11. The draft sill of claim 7 further comprising a rotation stop on the shelf, the rotation stop extending axially upward from the surface of the shelf, the rotation stop preventing full rotation of the center pin about its central longitudinal axis when the retainer key is on the shelf.

12. The draft sill of claim 1 mounted on a bolster of a railway car truck, the bolster having a plurality of walls and a center plate bowl receiving the center plate of the draft sill, the center plate bowl having an interior edge defining a central opening, the combination further including a center pin extending from the interior of the draft sill, through the central aperture in the center plate, through the central opening in the center plate bowl and into the interior of the bolster, the center pin including an upper retainer key supported on the shelf in the draft sill elongate channel and a lower retainer key extending diametrically through the center pin and through two walls of the bolster.

13. The draft sill of claim 1 wherein the draft sill comprises a draft sill end casting.

14. In combination, a draft sill for a railway car, a center pin and a retainer key, the draft sill including:

a pair of spaced side walls with bottom edges lying in a horizontal plane;

center plate having an exterior horizontal surface below the level of the horizontal plane of the bottom edges of the side walls, the exterior horizontal surface having an edge defining a central aperture; and an open member having a wall defining an elongate channel vertically aligned with the central aperture of the center plate, the elongate channel having a central longitudinal axis extending through the central aperture of the center plate;

wherein the open member includes a shelf defining an angle with the central longitudinal axis of the open member;

wherein the center pin includes one end positioned above the level of the horizontal plane of the bottom edges of the side walls and another end positioned below the level of the plane through the bottom edges of the side walls, the center pin extending along the elongate channel and through the central aperture of the center plate;

the draft sill further including a key passage through a portion of the draft sill;

the retainer key being supported on the shelf and extending to and contacting the center pin;

the key passage being sized, shaped and positioned to allow for passage of the retainer key from outside of the draft sill through the draft sill to the elongate channel.

15. The draft sill of claim 14 wherein the key passage extends through the shelf.

16. The draft sill of claim 14 wherein the key passage extends through the interior wall of the open member above the shelf.

17. The draft sill of claim 14 wherein the draft sill comprises a draft sill end casting.

18. In combination, a draft sill, a center pin and a railway truck bolster, the draft sill including a center plate and an open member, the center plate having an edge defining a central aperture and the open member having an elongate channel and a support member, the elongate channel being aligned with the central aperture of the center plate;

the center pin extending between the draft sill and the truck bolster, the center pin having a central longitudinal axis, one end in the draft sill and another end in the truck bolster, at least part of the center pin being in the elongate channel and at least part of the center pin extending through the central aperture of the center plate;

upper and lower retainer keys contacting the center pin to limit axial movement of the center pin and to limit relative vertical motion between the draft sill and the truck bolster;

the upper retainer key being supported on the support member and movable with the center pin, the lower retainer key limiting relative motion between the center pin and the truck bolster;

the draft sill including a key passage from the support member to the exterior of the draft sill;

the draft sill and truck bolster being separable by removing the lower retainer key and separating the draft sill and center pin from the truck bolster;

the center pin being removable from the draft sill by separating the draft sill and center pin from the truck bolster, turning the center pin about its central longitudinal axis, and moving the center pin and upper retainer key axially down through the elongate channel and key passage toward the center plate and through the central aperture in the center plate.

19. The combination of claim 18 wherein the lower retainer key extends through two walls in the bolster, the lower retainer key and bolster limiting rotation of the center pin about its central longitudinal axis.

20. In combination, a draft sill for a railway car, a center pin and a retainer key, the draft sill including:

a pair of spaced side walls with bottom edges lying in a plane;

a center plate having an exterior surface below the level of the plane through the bottom edges of the spaced side walls, the exterior surface having an edge defining a central aperture; and an open member having a wall defining an elongate channel aligned with the central aperture of the center plate, the elongate channel having a central longitudinal axis extending through the central aperture of the center plate;

wherein the open member includes a support member defining an angle with the central longitudinal axis of the open member, at least part of the support member being above the level of the horizontal plane through the bottom edges of the side walls of the draft sill;

wherein at least part of the center pin is disposed in the elongate channel and wherein the center pin has one end in the draft sill and a second end extending out of the draft sill to a position beyond the level of the exterior surface of the center plate;

the draft sill further including a key passage through a portion of the draft sill;

the retainer key being supported on the support member and extending to and contacting the center pin;

the key passage being sized, shaped and positioned to allow for passage of the retainer key from outside of the draft sill through the draft sill to the elongate channel.

* * * * *